US012247331B2

(12) United States Patent
Myogi et al.

(10) Patent No.: US 12,247,331 B2
(45) Date of Patent: Mar. 11, 2025

(54) WEFT INSERTION METHOD AND WEFT INSERTION DEVICE FOR AIR JET LOOM

(71) Applicant: TSUDAKOMA KOGYO KABUSHIKI KAISHA, Ishikawa-ken (JP)

(72) Inventors: Keiichi Myogi, Ishikawa-ken (JP); Kazuya Yama, Ishikawa-ken (JP); Toshiya Taima, Ishikawa-ken (JP)

(73) Assignee: TSUDAKOMA KOGYO KABUSHIKI KAISHA, Ishikawa-Ken (JP)

( * ) Notice: Subject to any disclaimer, the term of this patent is extended or adjusted under 35 U.S.C. 154(b) by 0 days.

(21) Appl. No.: 18/085,019

(22) Filed: Dec. 20, 2022

(65) Prior Publication Data

US 2023/0243075 A1 Aug. 3, 2023

(30) Foreign Application Priority Data

Jan. 28, 2022 (JP) ..... 2022-011779

(51) Int. Cl.
*D03D 47/30* (2006.01)

(52) U.S. Cl.
CPC ..... *D03D 47/3026* (2013.01); *D03D 47/3013* (2013.01)

(58) Field of Classification Search
USPC ..... 139/435.1
See application file for complete search history.

(56) References Cited

U.S. PATENT DOCUMENTS 4,493,459 A * 1/1985 Burkett ..... B02C 13/18 241/154
4,550,752 A * 11/1985 Manders ..... D03D 47/3013 139/435.4
4,838,321 A * 6/1989 Ishido ..... D03D 33/00 139/20

(Continued)

FOREIGN PATENT DOCUMENTS

CN 103103686 A * 5/2013 ..... D03D 47/30
CN 108642684 A 10/2018

(Continued)

OTHER PUBLICATIONS

Jun. 13, 2023, European Search Report issued for related EP Application No. 22215590.5.

*Primary Examiner* — Grace Huang
(74) *Attorney, Agent, or Firm* — Paratus Law Group, PLLC

(57) ABSTRACT

A weft insertion device includes a first main nozzle and a second main nozzle that is arranged upstream from the first main nozzle in a weft insertion direction and is configured to function as an auxiliary main nozzle. The first main nozzle is connectable to a first valve device by a first piping. The second main nozzle is connectable to a second valve device by a second piping shorter than the first piping. The weft insertion device is configured to supply compressed air to each main nozzle with each valve device being in an open state over a jet period from a predetermined jet starting timing. In a predetermined initial jet period that begins at the jet starting timing, an operating state of the second valve device is put into a small flow rate state, in which a flow rate smaller than a steady flow rate is supplied.

8 Claims, 6 Drawing Sheets

(56) References Cited

U.S. PATENT DOCUMENTS

| | | | | | |
|---|---|---|---|---|---|
| 4,953,596 | A * | 9/1990 | Takegawa | D03D 47/3033 | 139/55.1 |
| 4,967,807 | A * | 11/1990 | Lewyllie | D03D 51/085 | 139/452 |
| 5,107,902 | A * | 4/1992 | Wahhoud | D03D 47/3033 | 139/435.1 |
| 5,224,520 | A * | 7/1993 | Shinbara | D03D 47/3033 | 139/110 |
| 6,325,111 | B2 * | 12/2001 | Nakada | D03D 47/48 | 139/434 |
| 6,959,738 | B2 * | 11/2005 | Wahhoud | D03D 47/3053 | 139/450 |
| 7,055,554 | B2 * | 6/2006 | Fujitani | D03D 47/3033 | 139/435.2 |
| 7,726,351 | B2 * | 6/2010 | Puissant | D03D 47/3033 | 139/435.6 |
| 11,542,640 | B2 * | 1/2023 | Tamura | D03D 47/32 | |
| 2004/0025958 | A1 * | 2/2004 | Myogi | D03J 1/04 | 139/116.1 |
| 2023/0243075 | A1 * | 8/2023 | Myogi | D03D 47/3013 | 139/435.1 |

FOREIGN PATENT DOCUMENTS

| | | | | |
|---|---|---|---|---|
| EP | 0189919 | A1 * | 8/1986 | D03D 47/3033 |
| EP | 1420095 | A2 * | 5/2004 | D03D 47/3033 |
| EP | 1473391 | A1 * | 11/2004 | D03D 47/3033 |
| EP | 3640381 | B1 | 4/2021 | |
| JP | 03064552 | A * | 3/1991 | D03D 47/30 |
| JP | 2013-096038 | A | 5/2013 | |

* cited by examiner

WEFT INSERTION METHOD AND WEFT INSERTION DEVICE FOR AIR JET LOOM

CROSS-REFERENCE TO RELATED APPLICATION

This application is based on and claims priority under 35 USC § 119 from Japanese Patent Application No. 2022-011779, filed on Jan. 28, 2022, the entire contents of which are incorporated herein by reference.

TECHNICAL FIELD

The present invention relates to an air jet loom having a weft insertion device including a first main nozzle for weft insertion and a second main nozzle arranged upstream from the first main nozzle in a weft insertion direction and configured to function as an auxiliary main nozzle, in which the first main nozzle is connected to a first valve device by a first piping, the second main nozzle is connected to a second valve device by a second piping shorter than the first piping, and the weft insertion device is configured to supply compressed air to each main nozzle with each valve device being in an open state over a jet period from a predetermined jet starting timing.

BACKGROUND

For example, JP2013-096038A discloses a weft insertion device for an air jet loom. The weft insertion device includes, in addition to a main nozzle mainly contributing to weft insertion, a tandem nozzle functioning as an auxiliary main nozzle arranged upstream from the main nozzle in a weft insertion direction and configured to assist weft insertion by the main nozzle. That is, the weft insertion device is configured such that the main nozzle and the tandem nozzle cooperate to perform a single weft insertion.

Note that, in a general loom, the main nozzle is provided on a reed holder having a reed attached thereto and configured to swing in a front-rear direction of the loom during weaving. On the other hand, the auxiliary main nozzle is supported by a shaft erected on the loom frame via a bracket or the like, and is fixedly provided on the loom.

In addition, the weft insertion device includes solenoid valves each provided corresponding to each of the main nozzle and the auxiliary main nozzle and configured to control supply of compressed air to the main nozzle and the auxiliary main nozzle during the above-described weft insertion. In the weft insertion device, each solenoid valve is connected to the corresponding main nozzle or auxiliary main nozzle by a piping. Further, each solenoid valve is put into an open state over a jet period from a predetermined jet starting timing, so that the compressed air is supplied to the main nozzle and the auxiliary main nozzle and the above-described weft insertion is performed.

In the meantime, as also disclosed in JP2013-096038A, in a general loom, a weft insertion device is configured such that a piping from a solenoid valve to an auxiliary main nozzle is longer than a piping from a solenoid valve to a main nozzle. According to the configuration, there is a merit that rising in pressure of compressed air jetted from the auxiliary main nozzle becomes gentler than that of the main nozzle, and as a result, disorder in a posture of the weft that is inserted is suppressed.

However, in the case of the configuration, on the auxiliary main nozzle side, since a time until a residual pressure in the piping is completely removed becomes longer, there is a problem that the weft is damaged. More specifically, even when the solenoid valve in the open state during the jet period is closed at a jet ending timing, the compressed air (residual pressure) remains in the piping to the main nozzle and the auxiliary main nozzle remains at that time. Therefore, until the residual pressure is completely removed, an air flow corresponding to the pressure acts on the weft along the main nozzle and the auxiliary main nozzle. In addition, a time for which the air flow by the residual pressure acts is commensurate to a length of the piping. Therefore, in the configuration in which the piping to the auxiliary main nozzle is longer as described above, the air flow by the residual pressure acts on the weft for a long time on the auxiliary main nozzle side, so that the weft is damaged.

On the other hand, in looms in the related art, there is also a loom in which the weft insertion device is configured such that a piping from a solenoid valve to the auxiliary main nozzle is shorter than a piping on the main nozzle side. In this configuration, the above-described problem that the weft is damaged due to the air flow by the residual pressure is difficult to occur. However, in the configuration, contrary to the case where the piping on the auxiliary main nozzle side is longer as described above, the rising in pressure of the compressed air jetted from the auxiliary main nozzle becomes steeper than that of the main nozzle, and as a result, the disorder in the posture of the weft that is inserted occurs, which adversely affects the weft insertion.

Therefore, an object of the present invention is to provide a weft insertion method and a weft insertion device capable of suppressing disorder in a posture of a weft in weft insertion, which adversely affects the weft insertion, in an air jet loom having a weft insertion device configured such that a piping on an auxiliary main nozzle side is shorter than a piping on a main nozzle side so as to prevent a weft from being damaged by a residual pressure.

SUMMARY

The present invention presupposes an air jet loom having a weft insertion device including a first main nozzle for weft insertion and a second main nozzle arranged upstream from the first main nozzle in a weft insertion direction and configured to function as an auxiliary main nozzle, in which the first main nozzle is connected to a first valve device by a first piping, the second main nozzle is connected to a second valve device by a second piping shorter than the first piping, and the weft insertion device is configured to supply compressed air to each main nozzle with each valve device being in an open state over a jet period from a predetermined jet starting timing.

Further, a weft insertion method according to the present invention is characterized by putting, in the air jet loom having the weft insertion device as described above, an operating state of the second valve device into a small flow rate state, in which a flow rate smaller than a steady flow rate is supplied, in a predetermined initial jet period that begins at the jet starting timing.

BRIEF DESCRIPTION OF DRAWINGS

Exemplary embodiments of the present disclosure will be described in detail based on the following figures, wherein.

DESCRIPTION OF EMBODIMENTS

Hereinafter, one embodiment of a weft insertion device of an air jet loom to which the present invention is applied will be described with reference to FIGS. 1 to 6.

Figure 1:
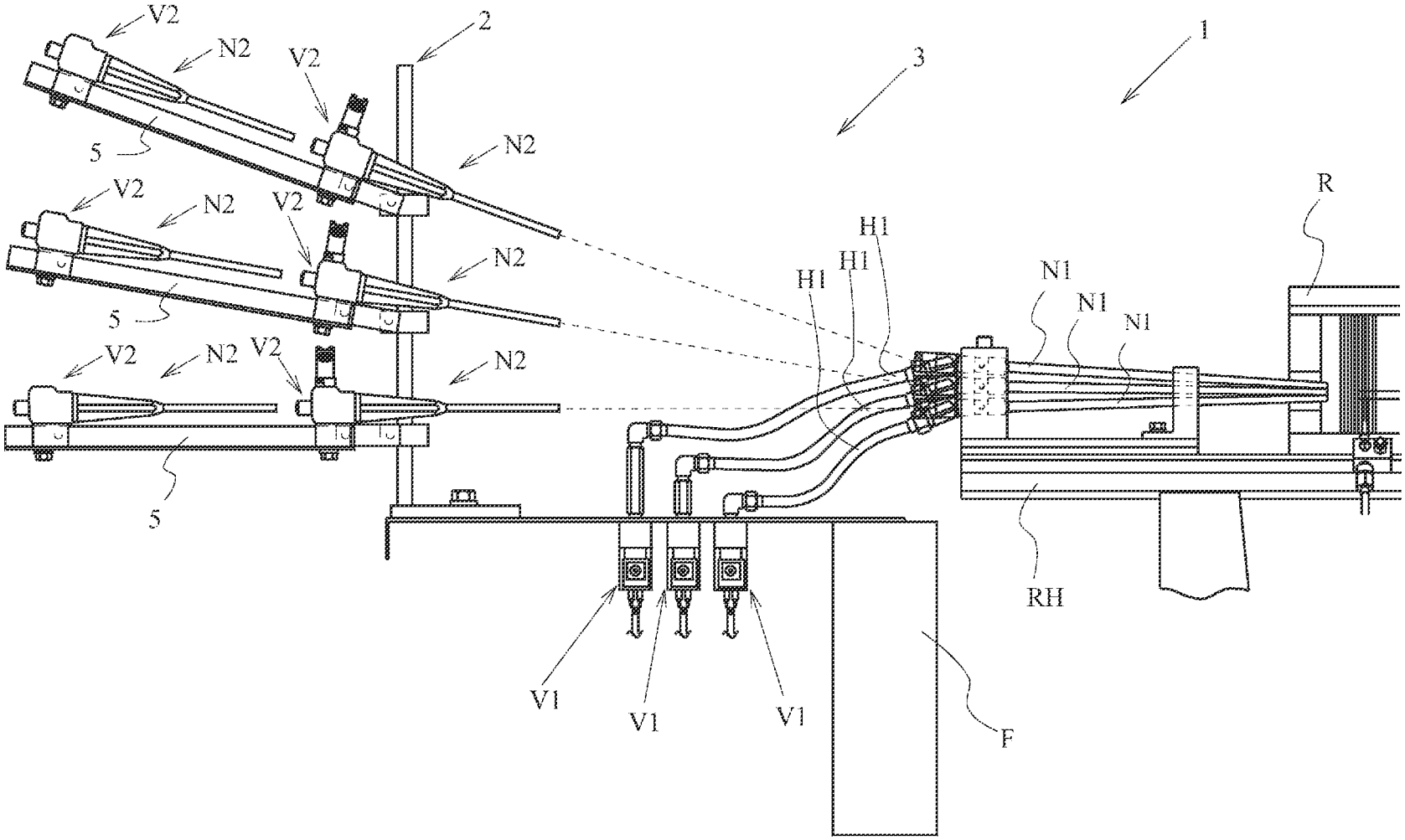
FIG. 1 is a front view of a weft insertion device for an air jet loom according to one embodiment of the present invention.
Figure 2:
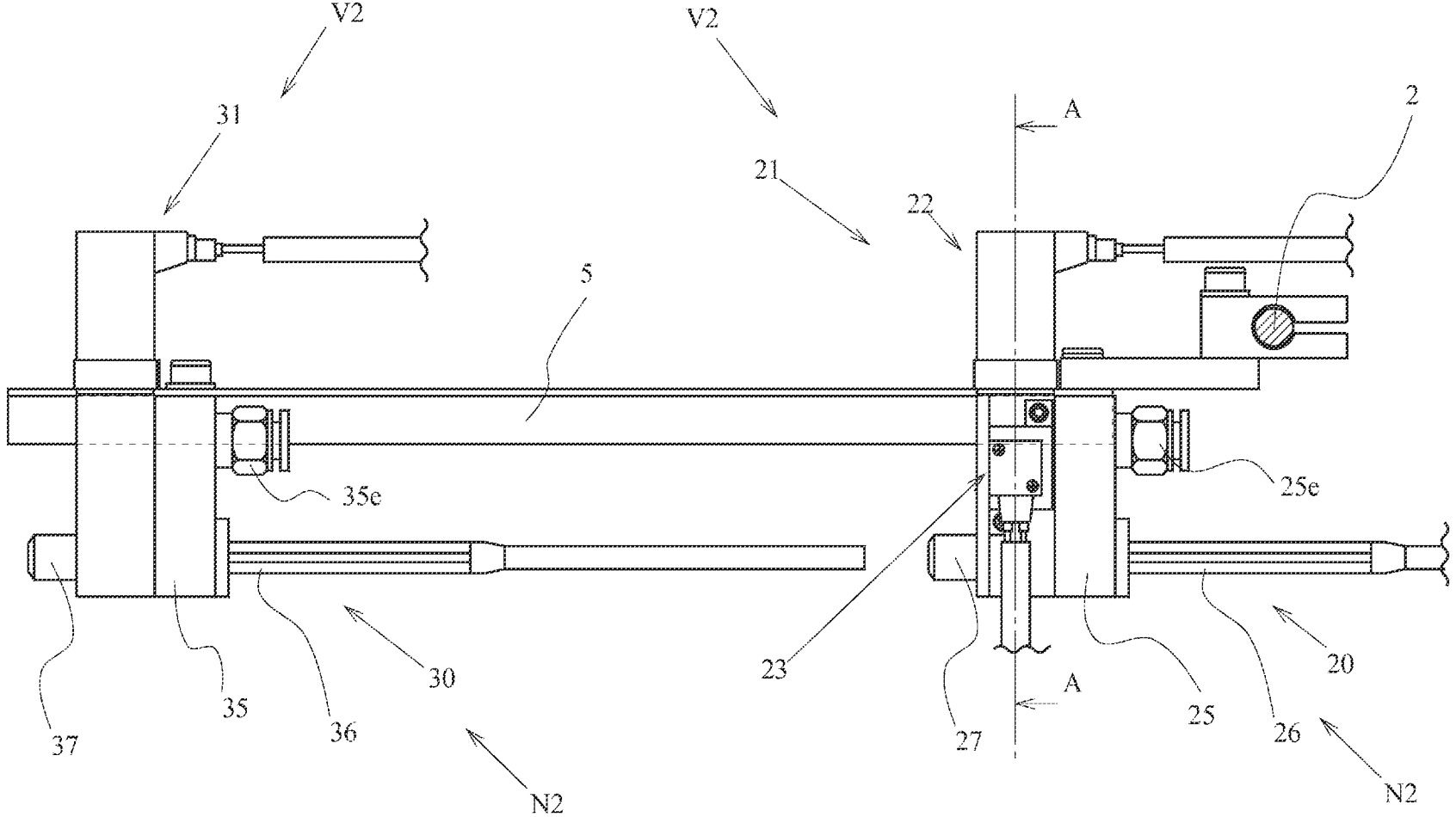
FIG. 2 is a plan view showing main part of the weft insertion device shown in FIG. 1.
Figure 3:
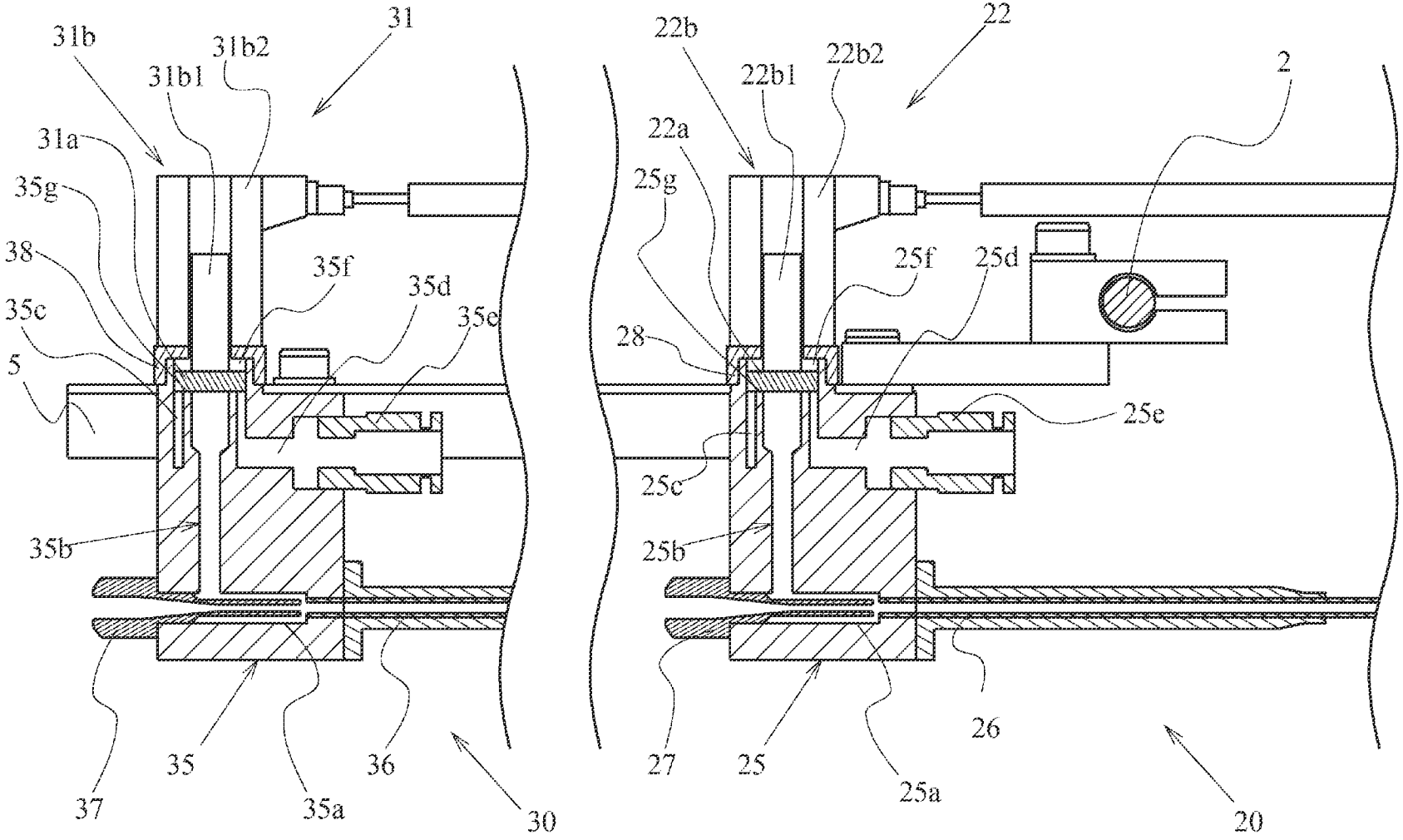
FIG. 3 is a partial cross-sectional plan view showing the main parts shown in FIG. 2.
Figure 4:
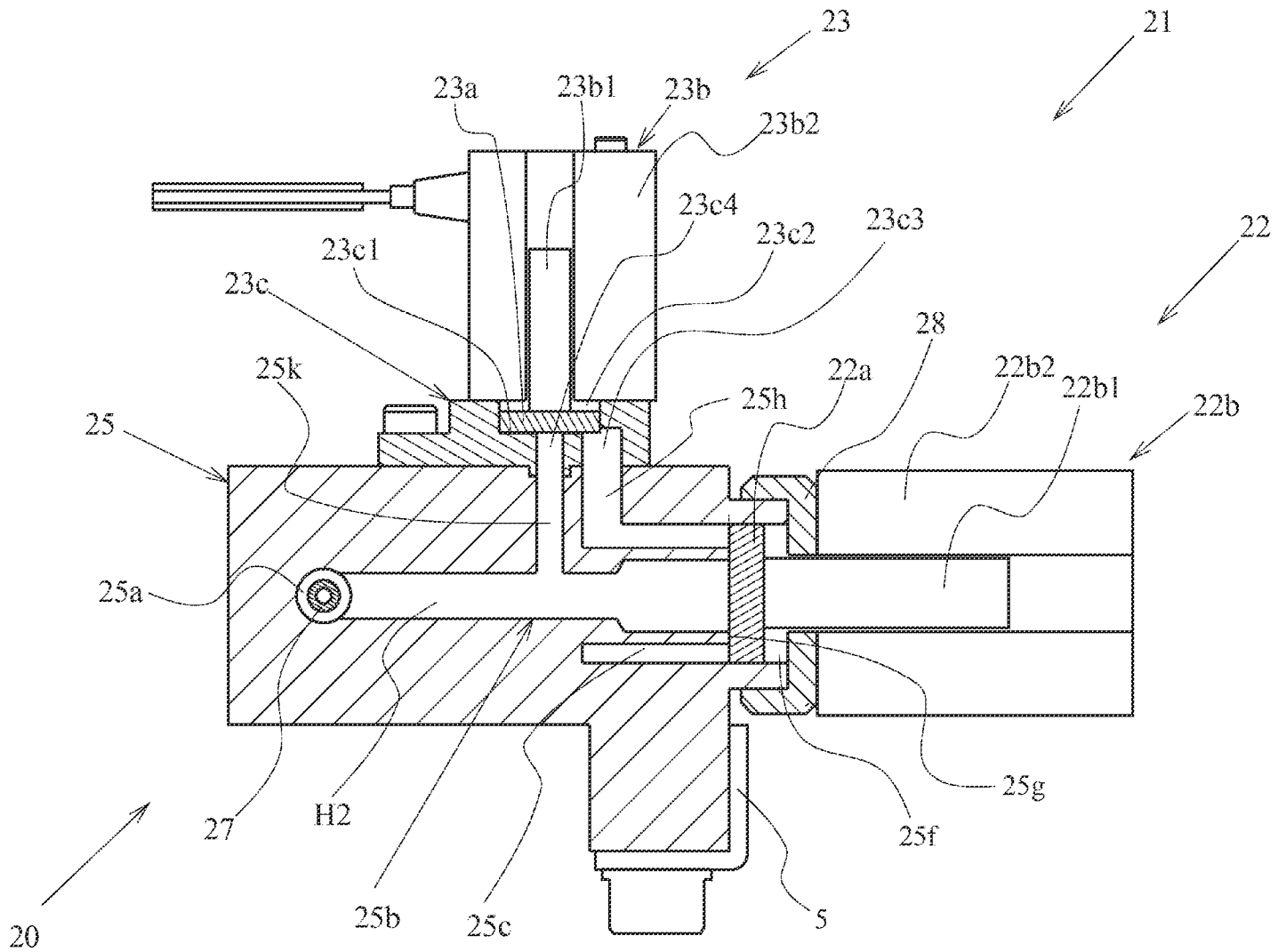
FIG. 4 is a cross-sectional view taken along a line A-A shown in FIG. 2.

FIG. 1 shows a weft insertion device 3 in an air jet loom 1, which the present invention presupposes, showing peripheral part of a main nozzle in the weft insertion device 3. As shown, the weft insertion device 3 includes, in addition to first main nozzles N1 as a main nozzle mainly contributing to weft insertion of a weft, auxiliary main nozzles N2 arranged upstream from the first main nozzles N1 in a weft insertion direction for the purpose of assisting the weft insertion by the first main nozzles N1.

Note that, in the shown example, the weft insertion device 3 is a multicolor weft insertion device 3 including a plurality of first main nozzles N1. In addition, in the weft insertion device 3, a set of two auxiliary main nozzles N2 and N2 is provided corresponding to each of the first main nozzles N1. Regarding the two auxiliary main nozzles N2 and N2 in each set, in the below, the auxiliary main nozzle arranged on an upstream side in the weft insertion direction is referred to as the upstream-side auxiliary main nozzle N2, and the auxiliary main nozzle arranged on a downstream side is referred to as the downstream-side auxiliary main nozzle N2.

For reference, in the weft insertion device 3, each of the first main nozzles N1 is provided on a reed holder RH to which a reed R is attached, the reed holder being configured to swing in a front-rear direction of the loom during weaving. On the other hand, the two auxiliary main nozzles N2 and N2 in each set are connected by a stay 5 and are supported via the stay 5 by a support stand 2 erected on a loom frame F, in the shown example. That is, each auxiliary main nozzle N2 is fixedly provided on the loom. Note that, the upstream-side and downstream-side auxiliary main nozzles N2 and N2 in each set are arranged so that they are aligned side by side in an axis direction and their axis centers coincide when seen from the axis direction. In addition, each auxiliary main nozzle N2 is provided such that an axis thereof is directed toward a rear end of the corresponding first main nozzle N1.

In addition, the weft insertion device 3 includes a valve device including a solenoid valve (electrically-actuated valve) provided corresponding to each main nozzle so as to control supply of compressed air to the first main nozzle N1 and each of the auxiliary main nozzles N2.

More specifically, each of the plurality of first main nozzles N1, as the first valve device in the present invention, is provided with a valve device V1 for the first main nozzles N1. In addition, each of the first valve devices V1 is fixedly provided such that it is attached to the loom frame F while the first main nozzle N1 is provided on the reed holder RH configured to swing. Each of the first valve devices V1 is connected to the corresponding first main nozzle N1 by a piping H1 as a first piping.

Further, each of the auxiliary main nozzles N2 is provided with a valve device V2 for the auxiliary main nozzles N2. Note that, although the details will be described later, in the present embodiment, the valve devices V2 are each provided integrally with each of the corresponding auxiliary main nozzles N2. Therefore, a piping connecting the valve device V2 provided integrally with the auxiliary main nozzle N2 and the auxiliary main nozzle N2 is shorter than the piping H1 connecting the first main nozzle N1 on the reed holder RH and the first valve device V1 on the frame F.

In the weft insertion device 3 configured as described above, during each weaving cycle, each of the valve devices V1 and V2 provided for the selected first main nozzle N1 and the auxiliary main nozzles N2 corresponding thereto is put into an open state at a predetermined jet starting timing, so that the compressed air is supplied to the first main nozzle N1 and each auxiliary main nozzle N2, the compressed air is jetted from the first main nozzle N1 and each auxiliary main nozzle N2, and the weft is accordingly inserted. Further, in the present embodiment, regarding the jet starting timing at which each of the valve devices V1 and V2 is put into the open state, the respective jet starting timings are set so that the jetting of the compressed air from the first main nozzle N1 is first started and the jetting of the compressed air is subsequently started in order of the downstream-side auxiliary main nozzle N2 and the upstream-side auxiliary main nozzle N2.

In the air jet loom 1 having the weft insertion device 3 configured as described above, in the present invention, the weft insertion device 3 is configured such that the valve devices V2 provided for the auxiliary main nozzles N2 corresponding to each of the first main nozzles N1 include a second valve device capable of being in a state in which a flow rate (steady flow rate) in a steady state of jetting of the auxiliary main nozzle N2 is supplied and also in a state (small flow rate state) in which a flow rate smaller than the steady flow rate is supplied. Furthermore, the present invention is characterized in that an operating state of the second valve device becomes the small flow rate state in a predetermined initial jet period that begins at the jet starting timing.

Further, the present embodiment is an example in which the valve device V2 provided for the downstream-side auxiliary main nozzle N2 in each set is the second valve device 21 described above. Therefore, the downstream-side auxiliary main nozzle N2 corresponds to the second main nozzle 20 in the present invention. On the other hand, as for the valve device V2 provided for the upstream-side auxiliary main nozzle N2 in each set, the valve device V2 is a valve device (third valve device) 31 configured so that an achievable operating state thereof is only the state in which the steady flow rate is supplied. Although the upstream-side auxiliary main nozzle N2 is the same auxiliary main nozzle in terms of the configuration, it is not the second main nozzle 20 but a third main nozzle 30.

As for the configuration common to each of the two auxiliary main nozzles N2 and N2 (the second main nozzle 20 and the third main nozzle 30) in each set, the configuration itself is the same as the known configuration, so that the detailed description thereof is omitted. However, the second main nozzle 20 and the third main nozzle 30 are mainly configured by nozzle main body parts 25 and 35 to which the compressed air is supplied, correspondingly to each main nozzle.

Further, the second main nozzle 20 and the third main nozzle 30 are configured to include thread guides 27 and 37 mounted on the corresponding nozzle main body parts 25 and 35, respectively, and pipe parts 26 and 36 provided integrally with the nozzle main body parts 25 and 35 such that they are inserted into the nozzle main body parts 25 and 35 at one end portions, respectively. The nozzle main body parts 25 and 35 corresponding to the respective main nozzles are formed with supply flow paths of the compressed air such that they communicate with through-holes 25*a* and 35*a* in which parts of the thread guides 27 and 37 are embedded. Note that, as for the nozzle main body parts 25 and 35, on the loom, a surface facing upward is referred to as an upper surface, a surface facing downward is referred to as a lower surface, a surface facing a downstream side in the weft insertion direction is referred to as a front surface and a surface facing an upstream side is referred to as a rear surface. In addition, two surfaces that are not the upper surface, the lower surface, the front surface, and the rear surface and are parallel to a penetration direction of the through-holes 25*a* and 35*a* are referred to as side surfaces.

As for the second main nozzle 20 and the third main nozzle 30, the third valve device 31 provided for the third main nozzle 30 is first described. The third valve device 31 is provided integrally with the nozzle main body part 35 of the corresponding third main nozzle 30. As for the nozzle main body part 35 for which the third valve device 31 is provided, the nozzle main body part 35 is formed with the supply flow path of the compressed air, as described above.

The supply flow path is configured to have a main flow path 35*b* configured to communicate with the through-hole 35*a*, an annular (doughnut shape in a cross section) flow path 35*c* formed around the main flow path 35*b*, and a lead-in flow path 35*d* into which the compressed air supplied from a compressed air supply source (not shown) flows (is introduced). In addition, the supply flow path is configured to have a communication flow path 35*f* formed to open to a side surface of the nozzle main body part 35 and to communicate with the main flow path 35*b* and the annular flow path 35*c*.

The supply flow path will be more specifically described. The communication flow path 35*f* is a flow path formed to open to one of the two side surfaces of the nozzle main body part 35 and also formed such that it is drilled in a direction (width direction) orthogonal to the one side surface. In addition, an inner diameter of the communication flow path 35*f* is substantially equal to an outer diameter of the annular flow path 35*c* that communicates with the communication flow path 35*f* as described above. Note that, the annular flow path 35*c* is a flow path formed around the main flow path 35*b* (so as to surround the main flow path 35*b*) as described above. Therefore, the inner diameter of the communication flow path 35*f* is naturally larger than an inner diameter of the main flow path 35*b*.

Further, the main flow path 35*b* extends in the width direction, and is formed to communicate with the communication flow path 35*f* on one end side thereof, to communicate with the through-hole 35*a* at the other end, as described above, and to communicate the through-hole 35*a* and the communication flow path 35*f* each other. Thereby, in the supply flow path, the communication flow path 35*f* and the through-hole 35*a* communicate by the main flow path 35*b*. Note that, the through-hole 35*a* with which the main flow path 35*b* communicates is part (flow path) to which the pipe part 36 is connected while the thread guide 37 of the third main nozzle 30 is embedded therein. Therefore, the inner diameter (flow path diameter) of the main flow path 35*b* has such a size that can realize the supply of the compressed air at a flow rate (the steady flow rate) that is a predetermined supposed flow rate and is determined so that a desired weft insertion is realized. For reference, in the shown example, a portion on one end side of the main flow path 35*b* is formed to have a slightly larger diameter than the other portions.

In addition, the annular flow path 35*c* is formed as an annular flow path around the main flow path 35*b* as described above. The annular flow path 35*c* is formed to communicate with the communication flow path 35*f* at one end thereof, as described above. Further, the annular flow path 35*c* is formed so that the other end is close to middle part of the main flow path 35*b* in the width direction. Note that, the annular flow path 35*c* is formed to surround the main flow path 35*b*, as described above, and its inner diameter is naturally larger than the inner diameter of the main flow path 35*b*. Therefore, the nozzle main body part 35 has an annular end face 35*g* exposed to the communication flow path 35*f* and provided between a communication end of the annular flow path 35*c* with the communication flow path 35*f* and a communication end of the main flow path 35*b* with the communication flow path 35*f*.

In addition, the lead-in flow path 35*d* is formed to open to the front surface of the nozzle main body part 35 and to communicate with a portion on the other end side of the annular flow path 35*c*. A pipe joint 35*e* to which a supply pipe for supplying the compressed air is connected is attached to the lead-in flow path 35*d*.

Further, as described above, the third valve device 31 provided for the nozzle main body part 35 configured in this way is a valve device configured such that the achievable operating state is only the state in which the steady flow rate is supplied, and is configured by a general solenoid valve that is the same as the valve device V1 in terms of the configuration. The third valve device 31 includes a disk-shaped valve body 31*a* and a valve body drive part 31*b* that is a part for driving the valve body 31*a*. In other words, part of the nozzle main body part 35 also serves as part of the third valve device 31. Furthermore, in the third valve device 31 configured in this way, the valve body drive part 31*b* is attached fixedly to the one side surface of the nozzle main body part 35.

Note that, the attachment of the valve body drive part 31*b* to the nozzle main body part 35 is performed via an attachment member 38. Specifically, the attachment member 38 is attached to the one side surface such that it covers part of the one side surface of the nozzle main body part 35 to which the communication flow path 35*f* is opened. In addition, a plate-shaped part of the attachment member 38 covering the communication flow path 35*f* (opening portion) is formed with a through-hole having an inner diameter smaller than the inner diameter of the communication flow path 35*f* at a position where a center coincides with the communication flow path 35*f* (main flow path 35*b*) when seen from the width direction.

In addition, the valve body drive part 31*b* is provided with a plunger 31*b*1 configured to be displaced in the axis line direction by a solenoid (not shown) embedded in a main body 31*b*2 and protruding from the main body 31*b*2. The valve body 31*a* is attached to a tip end of the plunger 31*b*1. Furthermore, the valve body drive part 31*b* is attached to the attachment member 38 attached to the nozzle main body part 35 as described above such that the plunger 31*b*1 is inserted into the through-hole of the attachment member 38.

Therefore, in a state (attached state) in which the valve body drive part 31*b* is attached to the attachment member 38 in this way, the valve body 31*a* is located in the communication flow path 35*f* in the nozzle main body part 35. In the attached state, one end face of the valve body 31*a* faces the annular end face 35*g* of the nozzle main body part 35, and the other end face faces the attachment member 38. For reference, an inner diameter of the through-hole in the attachment member 38 is naturally larger than an outer diameter of the plunger 31*b*1 (to be inserted), but is smaller than an outer diameter of the valve body 31*a*.

Note that, the outer diameter of the valve body 31*a* is substantially the same as (slightly smaller than) the inner diameter of the communication flow path 35*f*. In addition, a thickness of the valve body 31*a* is made smaller than a size of the communication flow path 35*f* in the width direction. Therefore, in the attached state, the valve body 31*a* is adapted to be slidable in the width direction in such a manner that its outer peripheral surface is guided to an inner peripheral surface of the communication flow path 35*f*. The sliding of the valve body 31*a* is regulated by the annular end face 35*g* of the nozzle main body part 35 and the attachment member 38. Furthermore, the valve body 31*a* has such a thickness that a gap in which the compressed air of the steady flow rate can flow is formed between the valve body 31*a* and the annular end face 35*g* in a state in which the valve body 31*a* slides toward the attachment member 38 and comes into contact with the attachment member 38.

In the third valve device 31 configured such that the valve body drive part 31*b* is attached to the nozzle main body part 35 as described above, when the plunger 31*b*1 is driven to bring the valve body 31*a* into contact with the annular end face 35*g*, the annular flow path 35*c* with which the lead-in flow path 35*d* communicates and the main flow path 35*b* communicating with the through-hole 35*a* in which the thread guide 37 is embedded are in a state (non-communication state) in which they are separated from each other by the valve body 31*a*. Thereby, even when the compressed air is supplied to the annular flow path 35*c* via the lead-in flow path 35*d*, the compressed air does not flow to the main flow path 35*b* side, and the compressed air is not jetted from the third main nozzle 30. Therefore, in this configuration, the annular end face 35*g* of the nozzle main body part 35 functions as a valve seat of the third valve device 31.

In addition, when the plunger 31*b*1 is driven to bring the valve body 31*a* into contact with the attachment member 38, the gap as described above is formed between the valve body 31*a* and the annular end face 35*g*, and the annular flow path 35*c* and the main flow path 35*b* are in a state (communication state) in which they communicate with each other. Thereby, the compressed air supplied to the annular flow path 35*c* via the lead-in flow path 35*d* flows to the main flow path 35*b* side, so that the jetting of the compressed air from the third main nozzle 30 is performed. Then, in the steady state of the jetting, the compressed air of the steady flow rate is jetted from the third main nozzle 30. Note that, the state of the third valve device 31 in which the valve body 31*a* comes into contact with the attachment member 38 in this way and the main flow path 35*b* communicates with the supply side by the gap of a size through which the compressed air of the steady flow rate can flow is a state in which the above-described "(achievable) operating state becomes a state in which the steady flow rate is supplied."

Next, the second valve device 21 provided for the second main nozzle 20 will be described. The second valve device 21 is also provided integrally with the nozzle main body part 25 of the corresponding second main nozzle 20. Note that, the supply flow path in the nozzle main body part 25 of the second main nozzle 20 also includes a communication flow path 25*f*, a main flow path 25*b*, an annular flow path 25*c*, and a lead-in flow path 25*d* formed similarly to the communication flow path 35*f*, the main flow path 35*b*, the annular flow path 35*c* and the lead-in flow path 35*d* of the supply flow path in the nozzle main body part 35 of the third main nozzle 30. In addition, in the supply flow path, an annular end face 25*g* exposed to the communication flow path 25*f* exists. Also, in the second main nozzle 20, a pipe joint 25*e* is attached to the lead-in flow path 25*d* in the nozzle main body 25.

Furthermore, as described above, the second valve device 21 is configured to switch its operating states between the state in which the steady flow rate is supplied and the small flow rate state, and in the present embodiment, is configured by combining two solenoid valves in which achievable operating states are different. The two solenoid valves include a solenoid valve (valve for steady flow rate) 22 configured such that an achievable operating state is only a state in which the steady flow rate is supplied, and a solenoid valve (valve for small flow rate) 23 configured such that an achievable operating state is only the small flow rate state.

Note that, the valve 22 for steady flow rate is the same as the third valve device 31 in terms of the configuration, and includes a valve body drive part 22*b* including a main body 22*b*2 and a plunger 22*b*1 configured to be displaced by a solenoid embedded in the main body 22*b*2, a valve body 22*a* attached to a tip end of the plunger 22*b*1 of the valve body drive part 22*b*, and a part except the valve body drive part 22*b*, which is part of the nozzle main body part 25 serving as part of the valve 22 for steady flow rate. The valve 22 for steady flow rate also has such a form that the valve body drive part 22*b* (main body 22*b*2) is attached to the nozzle main body part 25 via an attachment member 28, similarly to the third valve device 31. Also, in the valve 22 for steady flow rate, the valve body 22*a* is adapted to be slidable in the width direction in the communication flow path 25*f*.

In addition, similarly to the valve 22 for steady flow rate, the valve 23 for small flow rate is also configured to include a valve body drive part 23*b* including a main body 23*b*2 and a plunger 23*b*1 configured to be displaced in the axis direction by a solenoid embedded in the main body 23*b*2, and a valve body 23*a* attached to a tip end of the plunger 23*b*1 of the valve body drive part 23*b*.

Although the valve 22 for steady flow rate is configured such that the valve body 22*a* is accommodated and a valve seat (annular end face) 25*g* is formed as part of the nozzle main body part 25, the valve 23 for small flow rate includes a valve housing part 23*c* separate from the nozzle main body part 25, and is configured such that the valve housing part 23*c* is formed with a valve seat 23*c*1 and the valve body 23*a* is accommodated in the valve housing part 23*c*. That is, the valve 23 for small flow rate is configured by a combination of the valve body drive part 23*b* and the valve housing part 23*c*.

The valve housing part 23*c* will be more specifically described. The valve housing part 23*c* is a block-shaped member having a thick thickness. The valve housing part 23*c* is formed with an accommodation space 23*c*2 in which the valve body 23*a* is accommodated, an inflow flow path 23*c*3 configured to communicate with the accommodation space 23*c*2, the compressed air from the supply source being supplied to the inflow flow path, and an outflow flow path 23*c*4 configured to communicate with the accommodation space 23*c*2 and to cause the compressed air, which has flowed into the accommodation space 23*c*2 from the inflow flow path 23*c*3, to flow out.

Among them, the accommodation space 23*c*2 is a bottomed hole that is opened to only one of both end faces of the valve housing part 23*c* in a thickness direction, and is formed such that it is drilled in the thickness direction. Note that, the accommodating space 23*c*2 is formed to have a circular shape when seen from the thickness direction, and to have an inner diameter slightly larger than (substantially the same as) an outer diameter of the valve body 23*a*. In addition, the accommodation space 23*c*2 is formed so that a position of a bottom surface thereof is located substantially in the vicinity of a middle part of the valve housing part 23*c* in the thickness direction. That is, in the thickness direction, a size (depth dimension) of the accommodation space 23*c*2 is about a half of that of the valve housing portion 23*c*. However, the depth dimension of the accommodation space 23*c*2 is naturally larger than a thickness dimension of the valve body 23*a* to be accommodated.

In addition, the outflow flow path 23*c*4 is opened to the other end face of both end faces of the valve housing part 23*c*, and is formed to communicate with the accommodation space 23*c*2. Further, the outflow flow path 23*c*4 is formed at a position where a center of the flow path is made to coincide with a center of the accommodation space 23*c*2, when seen from the thickness direction. However, an inner diameter (flow path diameter) of the outflow flow path 23*c*4 is naturally smaller than the inner diameter of the accommodation space 23*c*2, and has a size sufficient to realize supply of the compressed air of a flow rate (small flow rate) smaller than the steady flow rate. In the valve housing part 23*c*, part of the bottom surface of the accommodation space 23*c*2 except for the part to which the outflow flow path 23*c*4 is opened is the valve seat 23*c*1.

In addition, the inflow flow path 23*c*3 is opened to the other end face of the valve housing part 23*c* at a position spaced apart from the outflow flow path 23*c*4 in a radial direction of the accommodation space 23*c*2, and is formed to be parallel to the outflow flow path 23*c*4. Note that, the inflow flow path 23*c*3 is formed so that a center of the flow path thereof is located in the vicinity of a peripheral edge of the accommodation space 23*c*2, when seen from the thickness direction. Therefore, on the accommodation space 23*c*2 side, about a half of the inflow flow path 23*c*3 is opened to the bottom surface.

In the valve 23 for small flow rate, the valve body drive part 23*b* is attached to the valve housing part 23*c* configured as described above such that the valve body 23*a* is positioned in the accommodation space 23*c*2 in the valve housing part 23*c*. Note that, as described above, the depth dimension of the accommodation space 23*c*2 in the valve housing part 23*c* is larger than the thickness of the valve body 23*a*. Therefore, in a state in which the valve body drive part 23*b* is attached to the valve housing part 23*c*, the valve body 23*a* is adapted to be slidable in the accommodation space 23*c*2. The sliding is regulated by the valve seat 23*c*1 that the valve body 23*a* faces, and the main body 23*b*2 of the valve body drive part 23*b*. Furthermore, the thickness of the valve body 23*a* is such that a gap in which the compressed air of the small flow rate can flow is formed between the valve body 23*a* and the valve seat 23*c*1 in a state in which the valve body 23*a* slides toward the main body 23*b*2 and comes into contact with the main body 23*b*2.

The valve 23 for small flow rate configured in such a manner that the valve body drive part 23*b* is attached to the valve housing part 23*c* is fixedly attached to the nozzle main body part 25 in a state in which the other end face of the valve housing part 23*c* is brought into contact with the upper surface of the nozzle main body part 25. Note that, as for the attachment, the attachment is performed in such an arrangement that in the width direction, a position of the inflow flow path 23*c*3 in the valve housing part 23*c* is made to coincide with a position (a position where the lead-in flow path 25*d* communicates) of a part on the other end side of the annular flow path 25*c* in the nozzle main body part 25 and the outflow flow path 23*c*4 is located on the other end face side of the nozzle main body part 25 (a side opposite to the side to which the valve 22 for steady flow rate is attached) with respect to the inflow flow path 23*c*3.

Furthermore, the nozzle main body part 25 to which the valve 23 for small flow rate is attached is formed with a lead-out flow path 25*h* configured to communicate the annular flow path 25*c* and the inflow flow path 23*c*3 in the valve housing part 23*c*, and a sub-flow path 25*k* configured to communicate the outflow flow path 23*c*4 in the valve housing part 23*c* and the main flow path 25*b* each other. Note that, the lead-out flow path 25*h* is a flow path having substantially the same inner diameter as that of the inflow flow path 23*c*3, and is formed in such a manner that a direction of the flow path thereof is made to coincide with a direction (vertical direction) orthogonal to the upper surface of the nozzle main body part 25. Therefore, a communication position of the lead-out flow path 25*h* with the annular flow path 25*c* is a position of the part on the other end side of the annular flow path 25*c* in the width direction, and is different from a position where the lead-in flow path 25*d* communicates with the annular flow path 25*c* in a circumferential direction. In addition, the sub-flow path 25*k* is a flow path having substantially the same inner diameter as that of the outflow flow path 23*c*4, and is formed in such a manner that a direction of the flow path thereof is made to coincide with the vertical direction, similarly to the lead-out flow path 25*h*.

In a state in which the second valve device 21 is provided integrally with the nozzle main body part 25 configured in this way, the valve 23 for small flow rate is in a state in which the outflow flow path 23*c*4 communicates with the main flow path 25*b* by the sub-flow path 25*k* in the nozzle main body part 25 as described above and communicates with the through-hole 25*a* via the main flow path 25*b*. In addition, as described above, the part of the valve 22 for steady flow rate except for the valve body drive part 22*b* is configured by part of the nozzle main body part 25. Therefore, part on the communication flow path 25*f* side of the main flow path 25*b* in the nozzle main body part 25 becomes a flow path (valve-side flow path) configuring a part of the second valve device 21. In other words, the main flow path 25*b* includes a valve-side flow path in the second valve device 21 and a nozzle-side flow path H2 configured to communicate the valve-side flow path and the through-hole 25*a*.

The sub-flow path 25*k* is configured to communicate with the nozzle-side flow path H2. For these reasons, it can be said that the second valve device 21 is connected to the through-hole 25*a* of the second main nozzle 20, in which the thread guide 27 is embedded, by the nozzle-side flow path H2 in the main flow path 25*b*. Therefore, the nozzle-side flow path H2 corresponds to the second piping in the present invention. Since the second piping H2 is a flow path formed in the nozzle main body part 25 with which the second valve device 21 is integrally provided, the second piping is obviously shorter than the piping H1 connecting the first main nozzle N1 of the reed holder RH shape and the frame and the first valve device V1 of the frame F shape each other.

In the second valve device 21 configured as described above, in a state in which the valve body 23*a* of the valve 23 for small flow rate is in contact with the valve seat 23*cl* of the valve housing part 23*c*, when the valve body 22*a* of the valve 22 for steady flow rate comes into contact with the attachment member 28, the compressed air supplied from the lead-in flow path 25*d* to the annular flow path 25*c* flows into the main flow path 25*b* via the gap between the valve body 22*a* and the valve seat (annular end face) 25*g*, similarly to the third valve device 31 described above. The operating state of the second valve device 21 is a state in which the compressed air of the steady flow rate is supplied.

On the other hand, in a state in which the valve body 22*a* of the valve 22 for steady flow rate is in contact with the valve seat 25*g*, when the valve body 23*a* of the valve 23 for small flow rate comes into contact with the main body 23*b*2, the compressed air supplied to the annular flow path 25*c* as described above does not flow into the main flow path 25*b* on the valve 22 side for steady flow rate, but flows into the inflow flow path 23*c*3 of the valve 23 for small flow rate via the lead-out flow path 25*h* from the annular flow path 25*c*. On the valve 23 side for small flow rate, the compressed air having flowed into the inflow flow path 23*c*3 flows into the outflow flow path 23*c*4 via the gap between the valve body 23*a* and the valve seat 23*c*1. Furthermore, the compressed air flowing through the outflow flow path 23*c*4 flows into the main flow path 25*b* via the sub-flow path 25*k*. In this way, in the operating state of the second valve device 21, the supplied compressed air flows into the main flow path 25*b* via the valve 23 for small flow rate, not the valve 22 side for steady flow rate. The operating state of the second valve device 21 is a state in which the small flow rate is supplied, i.e., the small flow rate state described above.

In any of the operating states, the compressed air flows into the main flow path 25*b* as described above, so that the jetting of the compressed air of the second main nozzle 20 is performed corresponding to the flow rate. For reference, in the state in which the valve body 22*a* of the valve 22 for steady flow rate is in contact with the attachment member 28, even when the valve body 23*a* of the valve 23 for small flow rate is in contact with the main body 23*b*2, due to a relationship between the size of the gap between the valve body and the valve seat in each of the valve 22 for steady flow rate and the valve 23 for small flow rate and the diameter of the flow path leading to the gap, the compressed air is more likely to flow into the valve 22 side for steady flow rate than the valve 23 side for small flow rate, so that the compressed air flows into the main flow path 25*b* mainly on the valve 22 side for steady flow rate. Therefore, the operating state is also a state in which the compressed air of the steady flow rate is supplied.

Figure 5:
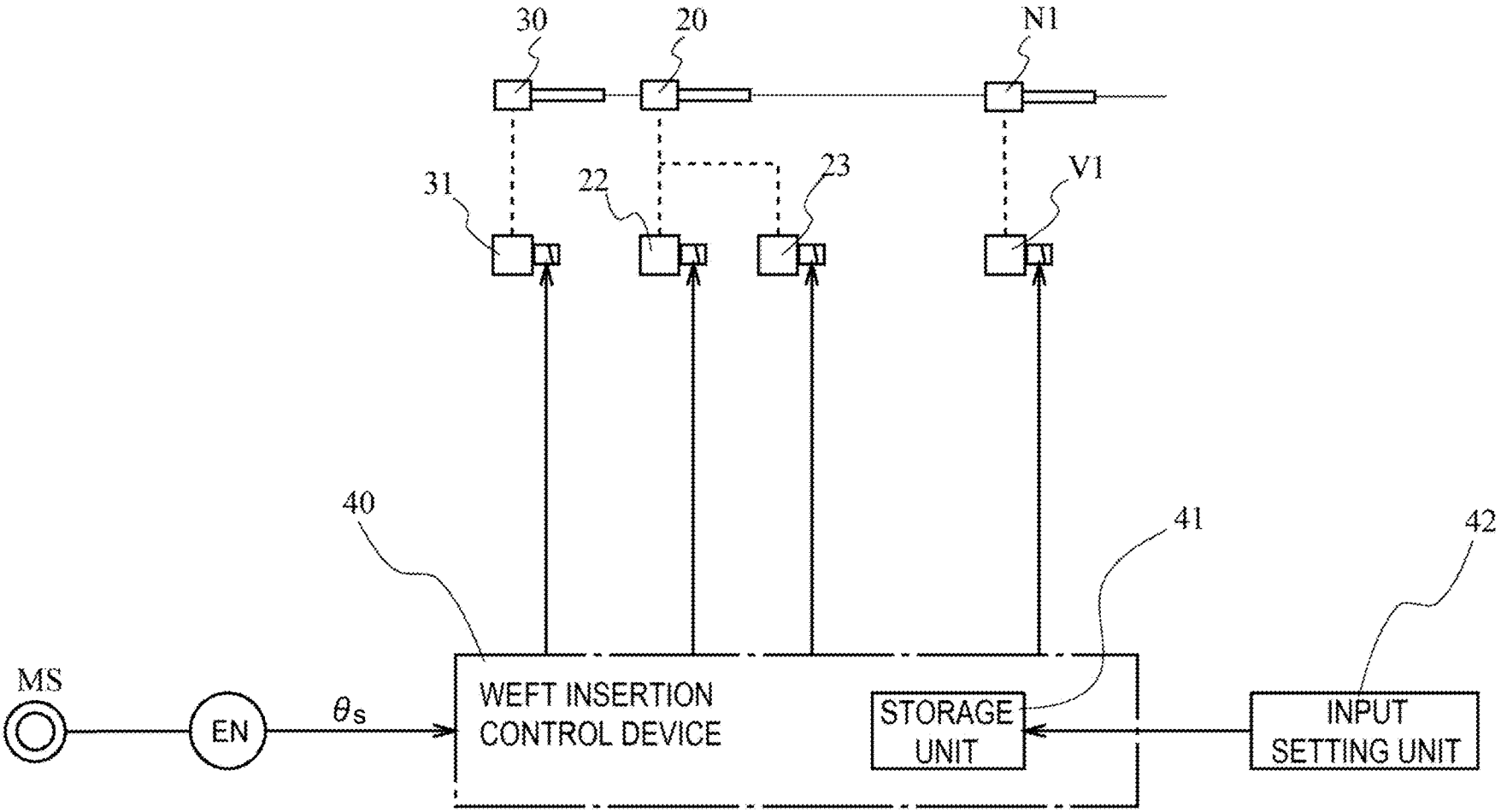
FIG. 5 illustrates the weft insertion device shown in FIG. 1.

Further, the weft insertion device 3 configured as described above includes a weft insertion control device 40 as a control device for controlling the operating states of the valve devices V1, 21 and 31 in each of the main nozzles N1, 20 and 30, as shown in FIG. 5. The weft insertion control device 40 includes a storage unit 41 in which weft insertion conditions including a jet period of the compressed air by each of the main nozzles N1, 20 and 30, and the like are stored. Note that, the weft insertion device 3 of the present embodiment includes the plurality of first main nozzles N1 and the two auxiliary main nozzles N2 and N2 (the second main nozzle 20 and the third main nozzle 30) provided for each of the first main nozzles N1. Furthermore, the weft insertion conditions stored in the storage unit 41 also include a weft insertion order for selecting which set of the main nozzles is caused to execute jetting (weft insertion) in each weaving cycle.

In addition, regarding the jet period included in the weft insertion conditions, it is assumed that a jet starting timing and a jet ending timing corresponding to the jet period are stored in the storage unit 41. However, it is assumed that the jet starting timing and the jet ending timing are each set by a rotation angle (crank angle) 6 of a main shaft MS of the loom. Further, it is assumed that the weft insertion conditions also include an initial jet period, which has the jet starting timing set for the second valve device 21, as a starting point, and is set in consideration of various conditions relating to weft insertion. That is, in the storage unit 41, the initial jet period is stored as one of the weft insertion conditions.

Further, the air jet loom 1 is provided with an input setting unit 42 for inputting and setting the above-described weft insertion conditions and the like. In addition, the input setting unit 42 is also connected to the storage unit 41 of the weft insertion control device 40. The above-described weft insertion conditions are input and set by the input setting unit 42, and the set weft insertion conditions are stored in the storage unit 41. Further, the air jet loom 1 is provided with an encoder EN configured to detect a rotation angle of the main shaft MS and to output the same as a crank angle signal θs. The encoder EN is also connected to the weft insertion control device 40 and is configured to output a crank angle signal θs corresponding to the detected rotation angle of the main shaft MS to the weft insertion control device 40.

The weft insertion control device 40 is configured, for a set of main nozzles selected in each weaving cycle, to control the operating states of the first valve device V1, the second valve device 21, and the third valve device 31, based on the weft insertion conditions stored in the storage unit 41 and the crank angle signal [0] Os from the encoder EN.

In addition, as for the jet starting timing set for each of the first valve device V1, the second valve device 21 and the third valve device 31, in the present embodiment, first, it is assumed that a jet starting timing (first jet starting timing) set for the first valve device V1 is set to a crank angle of 70°. Furthermore, since the second main nozzle 20 (the downstream-side auxiliary main nozzle N2 described above) starts jetting after the first main nozzle N1 starts jetting, as described above, it is assumed that a jet starting timing (second jet starting timing) set for the second valve device 21 is set to a crank angle of 80°, which is a crank angle later than the crank angle of 70° that is the first jet starting timing. In addition, since the third main nozzle 30 (the upstream-side auxiliary main nozzle N2 described above) starts jetting last, it is assumed that a jet starting timing (third jet starting timing) set for the third valve device 31 is set to a crank angle of 90°, which is a crank angle later than the crank angle of 80° that is the second jet starting timing.

Note that, in the present embodiment, it is assumed that the timings at which the jetting of each of the main nozzles N1, 20 and 30 ends are the same. Therefore, it is assumed that the jet ending timings set for the first valve device V1, the second valve device 21 and the third valve device 31 are all the same crank angle and are set to a crank angle of 180°.

In addition, as described above, the operating state of the second valve device 21 is the small flow rate state in the predetermined initial jet period that begins at the second jet starting timing. That is, in the initial jet period from the second jet starting timing, the second valve device 21 is put into an operating state in which only the valve 23 for small flow rate forming the small flow rate state is in the open state, and is switched to an operating state in which the valve 22 for steady flow rate, which is in a state in which the compressed air of the steady flow rate is supplied, is put into the open state, at the end of the initial jet period. Furthermore, in the present embodiment, it is assumed that the initial jet period is set in consideration of various conditions relating to weft insertion so that a timing at which a flow rate of the compressed air jetted from the second main nozzle 20 reaches the steady flow rate is substantially the same as a timing at which a flow rate of the compressed air jetted from the first main nozzle N1 reaches the steady flow rate.

Specifically, in the air jet loom 1 of the present embodiment, it is assumed that a timing at which a flow rate of the compressed air jetted from the first nozzle N1 reaches the steady flow rate is a crank angle of 100° in relation to the number of rotations of the loom set for weaving and the pressure of the compressed air supplied to each main nozzle. Further, as described above, the timing at which the second main nozzle 20 starts jetting is a time point that is delayed by the crank angle of 10° with respect to the timing at which the first main nozzle N1 starts jetting.

Further, as for the rising in flow rate of the compressed air jetted from the second main nozzle 20, it is assumed that a degree (an amount of increase in flow rate per unit time) of the rising in flow rate of the compressed air from the jet starting point in the small flow rate state in the second valve device 21 and a degree of rising in flow rate of the compressed air after switching from the small flow rate state to the state in which the steady flow rate is supplied are determined in advance by experiment or the like, based on the number of rotations of the loom and the pressure of the compressed air supplied to each main nozzle during weaving. Note that, as for the degrees of the rising in flow rate in both the states, the rising from the jet starting point in the small flow rate state is naturally gentler. Therefore, the longer the jet period in the small flow rate state is, the later the timing at which the flow rate of the compressed air jetted from the second main nozzle 20 reaches the steady flow rate is.

After taking the above into account, a timing after the second jet starting timing (crank angle of 80°) is obtained, at which if the small flow rate state is switched to the state in which the steady flow rate is supplied, a flow rate of the compressed air jetted from the second main nozzle 20 at a desired timing (in the present embodiment, crank angle of 100°) reaches the steady flow rate. Then, a period from the second jet starting timing up to the obtained switching timing becomes the initial jet period. Note that, in the present embodiment, it is assumed that the switching timing obtained in this way is a crank angle of 90°, and therefore, a period of a crank angle of 10° is set for the initial jet period.

Figure 6:
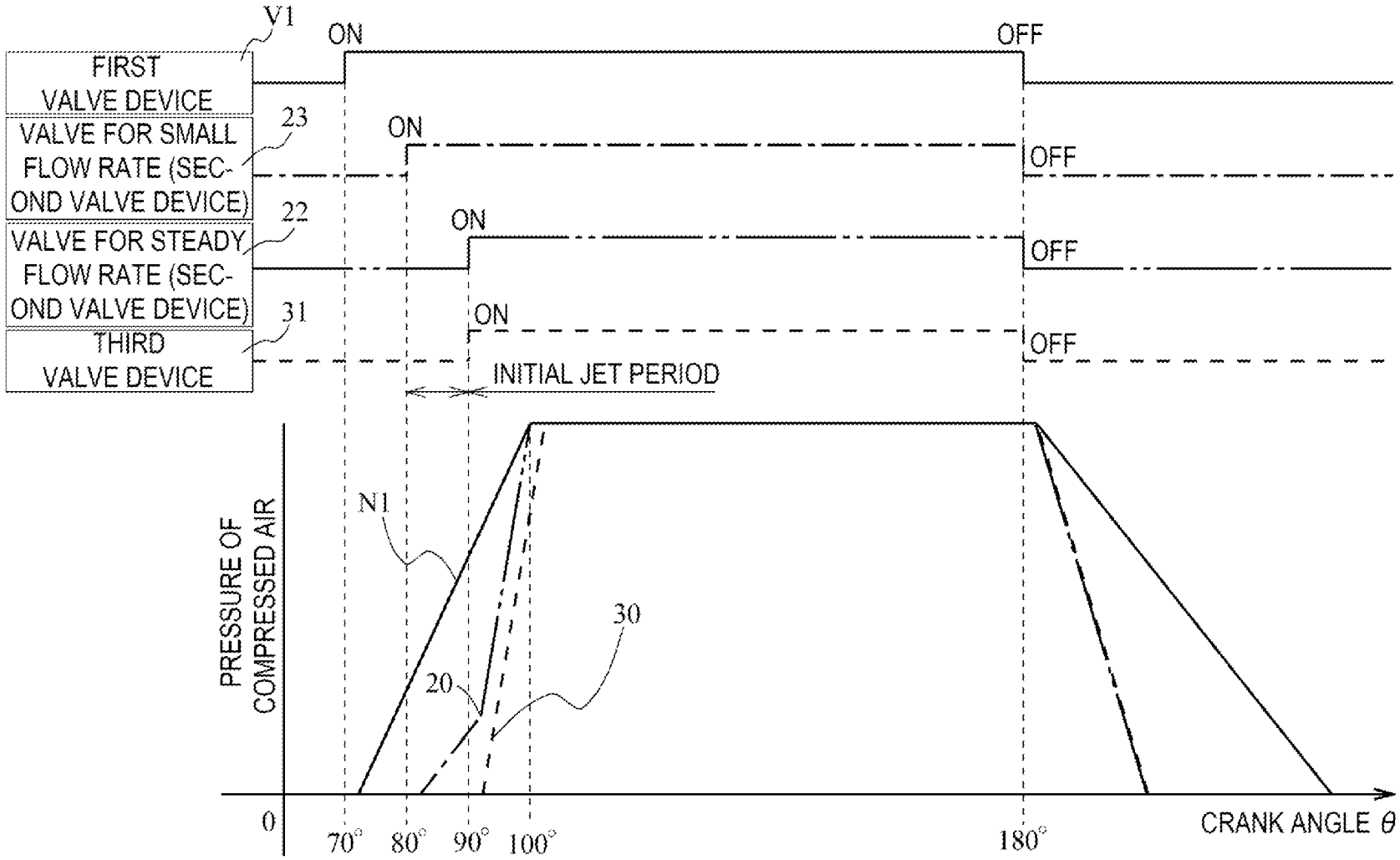
FIG. 6 is a timing chart diagram showing operating states of a first valve device, a second valve device, and a third valve device according to one embodiment of the present invention, and shows a pressure waveform of compressed air jetted from a first main nozzle, a second main nozzle and a third main nozzle.

In the weft insertion device 3 configured as described above, when the crank angle θ reaches 70° (first jet starting timing) in each weaving cycle, for a set of the main nozzles selected, as shown in FIG. 6, first, the drive for putting the first valve device V1 into an ON state (open state) is performed by the weft insertion control device 40, so that the operating state of the first valve device V1 becomes a state in which the steady flow rate is supplied. Thereby, the supply of the compressed air to the first main nozzle N1 via the first valve device V1 (jetting of the compressed air from the first main nozzle N1) is started. However, the supply of the compressed air is not started immediately when the first valve device V1 is put into the ON state, but, as shown in the drawing, is started with a slight time lag (2°) with respect to the set first jet starting timing.

In addition, the flow rate of the compressed air supplied to the first main nozzle N1 (jetted from the first main nozzle N1) does not reach the steady flow rate immediately when the supply of the compressed air to the first main nozzle N1 (the jetting of the compressed air from the first main nozzle N1) is started, but gradually increases toward the steady flow rate. The flow rate reaches the steady flow rate at the crank angle of 100°, as described above. Note that, as for the compressed air jetted from the first main nozzle N1, since there is a proportional relationship between the flow rate and the pressure, the pressure increases proportionally with the increase in flow rate as described above. The pressure becomes a pressure corresponding to the steady flow rate at the crank angle of 100°, which is the same timing as the timing at which the flow rate reaches the steady flow rate, as shown in FIG. 6.

Further, during a period from the start of the jetting of the compressed air from the first main nozzle N1 until the flow rate reaches the steady flow rate, when the crank angle θ reaches 80° (second jet starting timing), the drive of the second valve device 21 by the weft insertion control device 40 is started.

The drive is more specifically described. When the crank angle θ reaches 80°, the drive for putting only the valve 23 for small flow rate of the valve 22 for steady flow rate and the valve 23 for small flow rate in the second valve device 21 into an ON state (open state) is performed by the weft insertion control device 40, so that the operating state of the second valve device 21 becomes the small flow rate state. Thereby, in the second valve device 21, the supply of the compressed air to the second main nozzle 20 via the valve 23 for small flow rate as described above is started. Along with this, the jetting of the compressed air from the second main nozzle 20 is started.

However, the supply of the compressed air from the second valve device 21 (the jetting of the compressed air from the second main nozzle 20) is also started with a slight time lag with respect to the second jet starting timing, similarly to the first main nozzle N1 side. In addition, the flow rate of the compressed air supplied to the second main nozzle 20 (jetted from the second main nozzle 20) also does not immediately reach the flow rate supposed in the valve 23 for small flow rate as the small flow rate, but gradually increases toward the small flow rate.

Then, when 10° of the initial jet period elapses, i.e., the crank angle θ reaches 90° after the operating state of the second valve device 21 is put into the small flow rate state, the drive for putting the valve 22 for steady flow rate into the ON state (open state) is performed by the weft insertion control device 40. Thereby, the operating state of the second valve device 21 is switched from the small flow rate state to the state in which the steady flow rate described above is supplied. As a result, the supply of the compressed air to the second main nozzle 20 is switched from the supply via the valve 23 for small flow rate to the supply via the valve 22 for steady flow rate. The flow rate of the compressed air supplied to the second main nozzle 20 via the valve 22 for steady flow rate also reaches the steady flow rate at the crank angle of 100° that is the same as the timing at which the first main nozzle N1 side reaches the steady flow rate as described above.

In this way, as for the supply of the compressed air by the second valve device 21, the supply is performed in such a manner that the operating state of the second valve device 21 is first started as the small flow rate state in which the degree of the rising in flow rate is gentler than that in the state in which the steady flow rate is supplied and is then switched to the state in which the steady flow rate is supplied, after the predetermined initial jet period elapses. Thereby, the flow rate of the compressed air that is supplied first rises more gently than when the operating state of the second valve device 21 becomes the state in which the steady flow rate is supplied, passes through the gently rising portion, and then rises to a point where the steady flow rate is reached, in a form of corresponding to the state in which the steady flow rate is supplied. As a result, a time from when the supply of the compressed air is started at the second jet starting timing until the flow rate of the compressed air reaches the steady flow rate becomes longer, as compared with a case in which the operating state of the second valve device 21 is set to only the state in which the steady flow rate is supplied.

The pressure of the compressed air jetted from the second main nozzle 20 also rises similarly to the rising in flow rate described above, as shown in FIG. 6. Furthermore, as described above, the initial jet period is set in consideration of a difference in crank angle between the first jet starting timing and the second jet starting timing, and the crank angle at which the flow rate of the compressed air supplied to the first main nozzle N1 (jetted from the first main nozzle N1) reaches the steady flow rate. Therefore, the pressure of the compressed air jetted from the second main nozzle 20 does not precede the rising in pressure on the first main nozzle N1 side, and reaches the pressure corresponding to the steady flow rate (which is the same as the pressure of the compressed air jetted from the first main nozzle N1) at a time point when the flow rate reaches the steady flow rate. Therefore, since the pressure of the compressed air jetted from the second main nozzle 20 does not exceed the pressure of the compressed air jetted from the first main nozzle N1, it is possible to suppress occurrence of disorder in a posture of the weft that is weft-inserted.

In addition, in the process in which the flow rate of the compressed air jetted from the first main nozzle N1 and the second main nozzle 20 rises as described above, when the crank angle θ reaches 90° (third jet starting timing), the drive for putting the third valve device 31 into an ON state (open state) is also performed by the weft insertion control device 40, so that the operating state of the third valve device 31 also becomes a state in which the steady flow rate is supplied. Thereby, the supply of the compressed air to the third main nozzle 30 via the third valve device 31 (jetting of the compressed air from the third main nozzle 30) is also started. For reference, the flow rate of the compressed air supplied to the third main nozzle 30 reaches the steady flow rate at a timing slightly later than the crank angle of 100°.

After the flow rate of the compressed air supplied to (jetted from) each of the first main nozzle N1, the second main nozzle 20, and the third main nozzle 30 reaches the steady flow rate, as described above, the jetting state by the steady flow rate, i.e., the steady state of the jetting continues until the jet ending timing.

Furthermore, when the crank angle θ reaches 1800 that is the jet ending timing, the drive for putting the first valve device V1, the second valve device 21, and the third valve device 31 into an OFF state (closed state) is performed by the weft insertion control device 40. Thereby, the supply of the compressed air to the corresponding main nozzles via the first valve device V1, the second valve device 21 and the third valve device 31 is stopped.

Note that, even when the supply of the compressed air to each of the main nozzles is stopped in this way, the compressed air remains in the piping connecting each valve device and the main nozzle corresponding to each valve device. As for a pressure (residual pressure) of the compressed air remaining in each piping, the residual pressure in the second piping H2 is removed (becomes zero) faster than the residual pressure in the first piping H1 because the length of the second piping H2 (piping on the second main nozzle 20 side) is shorter than the length of the first piping H1 (piping on the first main nozzle N1 side). Therefore, as shown in FIG. 6, since a time until the residual pressure in each piping is completely removed (a time until the pressure of the compressed air jetted from each main nozzle becomes zero) is shorter on the second main nozzle 20 side (second piping H2 side) than the first main nozzle N1 side (first piping H1 side), the damage to the weft due to the residual pressure on the second main nozzle 20 side (in the second piping H2) is prevented.

In the above, one embodiment (hereinafter, referred to as "above embodiment") of the air jet loom having the weft insertion device to which the present invention is applied has been described. However, the present invention is not limited to the above embodiment, and can also be implemented by other embodiments (modified embodiments) as described below.

(1) As for the weft insertion device, in the above embodiment, the weft insertion device 3 is configured such that each of the plurality of first main nozzles N1 is correspondingly provided with the two auxiliary main nozzles N2 and N2. That is, the weft insertion device 3 is configured such that each set of the main nozzles includes the two auxiliary main nozzles N2 and N2. Furthermore, the weft insertion device 3 is configured such that the downstream-side auxiliary main nozzle N2 of the two auxiliary main nozzles N2 and N2 in each set is the second main nozzle 20 to which the second valve device 21 configured as described above is connected. However, in the present invention, even when the two auxiliary main nozzles are provided, the weft insertion device is not limited to the configuration as in the above embodiment, and may be configured such that the upstream-side auxiliary main nozzle is the second main nozzle.

Note that, in this case, the valve device connected to the downstream-side auxiliary main nozzle may be a valve device that is the same as the third valve device 31 in the above embodiment and an achievable operating state thereof is only the state in which the steady flow rate is supplied. Further, in the present invention, in the case in which each set of the main nozzles includes the two auxiliary main nozzles, the second main nozzle (auxiliary main nozzle to which the second valve device including the valve for small flow rate is connected) is not limited to one. Therefore, in addition to the upstream-side auxiliary main nozzle, the downstream-side auxiliary main nozzle may also be the second main nozzle.

(2) As for the second valve device, in the above embodiment, the second valve device 21 is configured by combining the valve 23 for small flow rate and the valve 22 for steady flow rate, and furthermore, the valve 23 for small flow rate and the valve 22 for steady flow rate are provided integrally with the second main nozzle 20. Specifically, the valve 23 for small flow rate is directly attached to the nozzle main body part 25 of the second main nozzle 20, and the valve 22 for steady flow rate is configured in such a form that the nozzle main body part 25 also serves as a part of the valve 22 for steady flow rate. However, in the present invention, the second valve device is not limited to such a configuration.

For example, as for the valve for steady flow rate, the part configured by the nozzle main body in the above embodiment may be formed as a member separate from the nozzle main body part, the valve for steady flow rate may be formed as a separate body from the second main nozzle (nozzle main body part), and the valve for steady flow rate may be directly attached to the nozzle main body part. In addition, as for the valve for small flow rate, similarly to the valve for steady flow rate in the above embodiment, the part formed as the valve housing part and as a member separate from the nozzle main body part in the above embodiment may be omitted, the nozzle main body part may be formed to include a similar part therein, and the valve for small flow rate may be configured in such a way that a part of the nozzle main body part in the second main nozzle also serves as a part (valve housing part) of the valve.

Further, in the case in which the valve for small flow rate is configured as a separate body from the second main nozzle (nozzle main body part), as in the above embodiment, and/or in the case in which the valve for steady flow rate is configured as a separate body from the second main nozzle (nozzle main body part), as described above, the valve configured as a separate body from the second main nozzle (nozzle main body part) is not limited to the configuration in which the valve is directly attached to the second main nozzle, as described above, and may be provided at a position spaced apart from the second main nozzle. In this case, the valve provided spaced apart from the second main nozzle and the nozzle main body part of the second main nozzle are connected to each other by a pipe or the like, and the pipe or the like becomes the second piping. However, even when the valve is provided spaced in this way, in the present invention, the valve is arranged at a position where a length of the second piping is shorter than the first piping H1 connecting the first valve device V1 and the first main nozzle N1 each other.

(3) As for the second valve device, in the above embodiment, the second valve device 21 is configured by combining the two solenoid valves (the valve 22 for steady flow rate and the valve 23 for small flow rate) whose operating states are different. However, in the present invention, the second valve device is not limited to the configuration in which the second valve device is configured by combining the two solenoid valves, and may also be configured only by one so-called throttle valve configured to be able to adjust (change) an opening amount (opening degree) between a valve body and a valve seat and capable of changing a flow rate of a fluid to be supplied corresponding to the opening degree.

In this case, the valve for small flow rate is omitted, and the throttle valve is provided instead of the valve for steady flow rate. As for an installation method of the throttle valve, the throttle valve may be directly attached to the nozzle main body part, as in the above embodiment, or may be provided at a position spaced apart from the nozzle main body part (second main nozzle), as described above. Note that, in the case in which the second valve device is configured in this way, the second valve device is driven to have an opening degree (opening for small flow rate) at which the supplied flow rate becomes a flow rate supposed as the small flow rate in the initial jet period from the second jet starting timing, and to have an opening degree (opening for steady flow rate) at which the supplied flow rate becomes a flow rate supposed as the steady flow rate at a time point when the initial jet period has elapsed. In this case, as for the operating state of the second valve device, a state in which the opening degree for small flow rate is made is the small flow rate state, and a state in which the opening degree for steady flow rate is made is the state in which the steady flow rate is supplied.

In addition, even when the second valve device 21 is configured by combining two valves as in the above embodiment, the throttle valve as described above may be used for the valve for small flow rate so that the flow rate to be supplied can be changed, instead of the solenoid valve (valve for small flow rate) as in the above embodiment. Note that, when the second valve device is configured to include a throttle valve, it is preferably to provide solenoid valve on an upstream side of the throttle valve (between the throttle valve and the supply source of the compressed air) and to switch the on/off state (opening/closing) by the solenoid valve, in consideration of responsiveness of the throttle valve.

(4) As for the small flow rate state in the initial jet period, in the above embodiment, the valve 23 for small flow rate is configured to be in an open state in which a flow rate supposed as the small flow rate can be supplied, and the valve 23 for small flow rate is put into the open state over the initial jet period, so that the small flow rate state is realized. However, in the present invention, the small flow rate state in the initial jet period is not limited to being realized by putting a single valve configured to supply the flow rate supposed as the small flow rate into the open state over the initial jet period.

For example, in addition to a solenoid valve (first valve for small flow rate) corresponding to the valve 23 for small flow rate in the above embodiment, the second valve device may have a solenoid valve (second valve for small flow rate) having a similar configuration and configured such that a supposed flow rate is larger than that in the first valve for small flow rate and smaller than the steady flow rate, and the small flow rate state may be realized by switching both the valves for small flow rate in the initial jet period.

Specifically, the initial jet period may be divided into two periods. i.e., a period (former period) from the second jet starting timing and a period (latter period) from an end time point of the former period to an end time point of the initial jet period, and the small flow rate state may be realized by putting the first valve for small flow rate into the open state (putting the second valve for small flow rate into the closed state) in the former period and putting the second valve for small flow rate into the open state in the latter period. In this case, the degree of the rising in flow rate (pressure) in the small flow rate state is different from each other in the former period and the latter period of the initial jet period even during the initial jet period (the degree of the rising is larger in the latter period). In this way, the small flow rate state in the present invention is not limited to a state in which a flow rate (pressure) rises at a certain level over the initial jet period, and may be realized such that the flow rate (pressure) changes and rises in the middle of the initial jet period.

Note that, in the case in which the second valve device is configured to include two valves for small flow rate as described above, for example, two lead-out flow paths with different phases around the annular flow path 25*c* may be formed to communicate with the annular flow path 25*c*, and both the valves for small flow rate may be connected to each of the lead-out flow paths. In addition, the second valve device may be configured to include three or more valves for small flow rate configured so that the supposed flow rates are different, and the degree of the rising in flow rate in the small flow rate state may be changed to three or more. Further, in the case in which the small flow rate state is realized in such a manner that the degree of the rising in flow rate is changed in the middle of the initial jet period, instead of using a plurality of valves for small flow rate as described above, an opening degree of one throttle valve provided instead of the solenoid valve may be changed to realize the small flow rate state.

(5) As for the initial jet period, in the above embodiment, on the premise that the timing (second steady arrival timing) at which the flow rate of the compressed air jetted from the second main nozzle 20 reaches the steady flow rate is made to substantially coincide with the timing (first steady arrival timing) at which the flow rate of the compressed air jetted from the first main nozzle N1 reaches the steady flow rate, the initial jet period is set in consideration of various conditions relating to the weft insertion.

However, in the present invention, the second steady arrival timing is not limited to being set to substantially coincide with the first steady arrival timing as in the above embodiment, and may be set to a timing prior to the first steady arrival timing as long as the disorder in the posture of the weft to a degree that adversely affects the weft insertion does not occur. In addition, the second steady arrival timing may be determined as a timing later than the first steady arrival timing, provided that the weft is not damaged to the serious extent in relation to traction by the jetting of the first main nozzle. The initial jet period is set in consideration of the second steady arrival timing determined in this way.

Further, as for the second jet starting timing that is a starting point of the initial jet period, in the above embodiment, the second jet starting timing is set with the crank angle of 80° that is later by the crank angle of 10° with respect to the crank angle of 70° that is the first jet starting timing. However, even when the second jet starting timing is set later than the first jet starting timing as such, the difference from the first jet starting timing is not limited to being the crank angle of 10°, and may be set as appropriate in consideration of the various conditions and the like. Further, the second jet starting timing is not limited to being set later than the first jet starting timing, and may be set to be the same as the first jet starting timing, or may be set prior to the first jet starting timing as long as the disorder in the posture of the weft to a degree that adversely affects the weft insertion does not occur.

Note that, in the above embodiment, as described above, the third main nozzle 30 is provided upstream from the second main nozzle, and the third jet starting timing set for the third main nozzle 30 (third valve device 31) is set with the crank angle of 90° that is later by the crank angle of 10° with respect to the crank angle of 80° that is the second jet starting timing. However, the third jet starting timing is not limited to being set later than the second jet starting timing as such, and may be the same as the second jet starting timing or may be set prior to the second jet starting timing.

(6) As for the weft insertion device, in the above embodiment, the weft insertion device 3 has the configuration in which each of the first main nozzles N1 is provided with the two auxiliary main nozzles N2 and N2 (the second main nozzle 20 and the third main nozzle 30). However, the weft insertion device of the present invention is not limited to being configured to include the two auxiliary main nozzles as such, and the third main nozzle, which is the upstream-side auxiliary main nozzle, may be omitted and only the second main nozzle, which is the downstream-side auxiliary main nozzle, may be provided. In addition, the weft insertion device may be configured to include three (or more) auxiliary main nozzles. In this case, one or more auxiliary main nozzles among the plurality of auxiliary main nozzles are configured to be the second main nozzles.

Further, the weft insertion device to which the present invention is applied is not limited to the configuration in which the plurality of first main nozzles N1 are provided as in the above embodiment, and may be configured to include only one first main nozzle.

The present invention is not limited to the above embodiment, and can be variously changed without departing from the gist of the present invention.

Note that, the "operating state" regarding the second valve device refers to a state (open state) mechanically determined with respect to the valve device. That is, although the operating state is expressed in relation to the flow rate as in the "state in which the flow rate is supplied" described above, the operating state refers to a mechanically open state as a result of an operation of the valve device, i.e., a state made into an open state in which a pre-supposed flow rate (supposed flow rate) can be supplied, not a state considering a relationship with a flow rate (actual flow rate) of the compressed air that is actually supplied from the valve device.

More specifically, the valve device operates at the jet starting timing and is put into a set mechanically open state. However, the actual flow rate does not reach the supposed flow rate corresponding to the open state of the valve device in a moment but reaches the supposed flow rate through a gradually increasing process. As such, even when the valve device is in the mechanically open state set corresponding to the supposed flow rate, regarding the actual flow rate, the state also includes a state in which a flow rate smaller than the supposed flow rate is supplied. However, the "operating state" of the valve device in the present invention is not a state in which the actual flow rate that changes is taken into account, but refers to a state of the valve device put into the mechanically open state determined in relation to the supposed flow rate.

Furthermore, the "steady flow rate" refers to a flow rate in the steady state of jetting as described above, and more specifically, a flow rate that is supplied, at a time when the jetting is in a steady state in each main nozzle, from a valve device corresponding to the main nozzle. In addition, the steady state of the jetting refers to a state in which the actual flow rate supplied from the valve device to the main nozzle during a weft insertion period is the supposed flow rate.

Further, as for the "(predetermined) initial jet period" described above, the initial jet period is a period in which the jet starting timing set for the second valve device as described above is set as a starting point. However, the period (ending point) is determined in consideration of various conditions relating to the weft insertion. Note that, the various conditions includes what a relationship the jet starting timing for the second valve device is set with respect to the jet starting timing for the first valve device, a setting pressure of the compressed air that is supplied to the second valve device, a setting number of rotations of the loom (main shaft), a length of the first piping that greatly affects a rising characteristic of the pressure of the compressed air that is jetted from the first main nozzle, and the like.

Further, in the weft insertion device according to the present invention, the second valve device is configured to switch its operating states between a state in which the steady flow rate, which is a flow rate in the steady state of the jetting, is supplied and the small flow rate state that is a state in which a flow rate smaller than the flow rate in the steady state is supplied. The weft insertion device includes a storage unit in which a predetermined initial jet period that begins at the jet starting timing is stored, and a control device configured to switch an operating state of the second valve device and to put the operating state of the second valve device into the small flow rate state in the initial jet period.

Further, in the weft insertion method and the weft insertion device according to the present invention, the weft insertion device may be provided with a third main nozzle arranged upstream from the second main nozzle and connected to a third valve device, and the third valve device may be put into the state in which the steady flow rate is supplied over the jet period. Further, in the weft insertion method and the weft insertion device according to the present invention, the weft insertion device may be configured such that the second valve device is provided integrally with the second main nozzle.

According to the present invention, the weft insertion device is configured such that the second main nozzle as an auxiliary main nozzle arranged upstream from the first main nozzle (main nozzle) is connected to the corresponding second valve device by the piping (second piping) shorter than the piping (first piping) on the first main nozzle side. Therefore, according to the configuration, the above-described problem that the weft is damaged due to the residual pressure on the second main nozzle (second piping) side is difficult to occur.

Furthermore, in the present invention, in the initial jet period in which the jet starting timing, which is a starting point of the jet period, is set as a starting point, the operating state of the second valve device becomes a small flow rate state in which a flow rate smaller than the steady flow rate is supplied. Thereby, in the initial jet period, as compared with the configuration in which the operating state of the second valve device is a state in which the steady flow rate is supplied over the entire jet period, as in the weft insertion device of the related art, the supply flow rate of the compressed air that is supplied to the second main nozzle becomes smaller than the steady flow rate. Therefore, according to the present invention, since the rising in pressure of the compressed air that is jetted from the second main nozzle becomes gentle in the initial jet period, the disorder in the posture of the weft that is weft-inserted is suppressed, and therefore, the problem that the weft insertion is adversely affected can be prevented as much as possible.

Further, in the weft insertion device according to the present invention, the third valve device to which the auxiliary main nozzle (third main nozzle) arranged upstream from the above-described second main nozzle is connected is put into the state in which the steady flow rate is supplied over the entire jet period. As a result, the configuration of the weft insertion device can be simplified as a whole.

More specifically, in a case in which the weft insertion device has two or more auxiliary main nozzles on an upstream side of the first main nozzle, all of the auxiliary main nozzles are not set as the second main nozzle (auxiliary main nozzle connected to the second valve device), and instead, the auxiliary main nozzle (less than the total number) located on a downstream side is set as the second main nozzle, and the other auxiliary main nozzles on the upstream side are set as the third auxiliary main nozzles connected to the third valve device as described above. Even in this case, the effect of the present invention can be obtained.

The third valve device is configured only to be in the state in which the steady flow rate is supplied as described above, and may be a simple solenoid valve configured to simply switch the open state and the closed state, and therefore, is simpler in terms of the configuration, as compared with the second valve device configured to be able to change the supply flow rate. Therefore, in the case in which the two or more auxiliary main nozzles are provided, the configuration of the weft insertion device can be further simplified, as compared with the case in which all auxiliary main nozzles are set as the second main nozzles described above.

Further, in the weft insertion device according to the present invention, the weft insertion device is configured such that the second valve device is provided integrally with the second main nozzle. Thereby, the problem that the weft is damaged due to the residual pressure as described above is more difficult to occur. In addition, the present invention contributes more effectively in terms of the effect of suppressing the disorder in the posture described above.

More specifically, the weft insertion device is configured such that the second valve device connected to the second main nozzle is provided integrally with the second main nozzle. Therefore, on the second main nozzle side, the second piping connecting the second main nozzle and the second valve device is extremely short, as compared with the case in which the second valve device is provided at a position spaced apart from the second main nozzle. In this case, the problem that the weft is damaged due to the residual pressure in the second piping is more difficult to occur.

However, the second piping is shortened in this way, so that the rising in pressure of the compressed air from the jetting start on the second main nozzle side becomes steeper. Therefore, by applying the present invention capable of moderating the rising in pressure of the compressed air on the second main nozzle side to the weft insertion device configured as such, the present invention functions (contributes) more effectively in terms of the effect of suppressing the disorder in the posture described above.

REFERENCE SIGNS

1: air jet loom
2: support stand
3: weft insertion device
5: stay
F: loom frame
R: reed
RH: reed holder
MS: main shaft
EN: encoder
N1: main nozzle (first main nozzle)
N2: auxiliary main nozzle
V1: valve device for main nozzle (first valve device)
V2: valve device for auxiliary main nozzle (second valve device)
H1: piping (first piping)
H2: nozzle-side flow path (second piping)
20: second main nozzle
21: second valve device
22: valve for steady flow rate
22*a*: valve body
22*b*: valve body drive part
22*b*1: plunger
22*b*2: main body
23: valve for small flow rate
23*a*: valve body
23*b*: valve body drive part
23*b*1: plunger
23*b*2: main body

23*c*: valve housing part
23*cl*: valve seat
23*c*2: accommodation space
23*c*3: inflow flow path
23*c*4: outflow flow path
25: nozzle main body part
25*a*: through-hole
25*b*: main flow path
25*c*: annular flow path
25*d*: lead-in flow path
25*e*: pipe joint
25*f*: communication flow path
25*g*: annular end face (valve seat)
25*h*: lead-out flow path
25*k*: sub-flow path
26: pipe part
27: thread guide
28: attachment member
30: third main nozzle
31: third valve device
31*a*: valve body
31*b*: valve body drive part
31*b*1: plunger
31*b*2: main body
35: nozzle main body part
35*a*: through-hole
35*b*: main flow path
35*c*: annular flow path
35*d*: lead-in flow path
35*e*: pipe joint
35*f* communication flow path
35*g*: annular end face (valve seat)
36: pipe part
37: thread guide
38: attaching member
40: weft insertion control device (control device)
41: storage unit
42: input setting unit

The invention claimed is:

1. A weft insertion method for an air jet loom, wherein the loom comprises a weft insertion device including:
- a first main nozzle for weft insertion; and
- a second main nozzle that is arranged upstream from the first main nozzle in a weft insertion direction and is configured to function as an auxiliary main nozzle, the first main nozzle is connectable to a first valve device by a first piping, the second main nozzle is connectable to a second valve device by a second piping shorter than the first piping, the weft insertion device is configured to supply compressed air to each main nozzle with each valve device being in an open state over a jet period from a predetermined jet starting timing, the second valve device includes a single lead-in flow path into which compressed air is supplied and is configured by combining:
- a valve for steady flow rate that implements a state in which the steady flow rate, which is a flow rate in a steady state of jet, is supplied; and
- a valve for small flow rate that implements a small flow rate state, which is a state in which a flow rate smaller than the steady flow rate is supplied,
- the second valve device is configured to switch an operating state of the second valve device between the state in which the steady flow rate is supplied and the small flow rate state, the weft insertion device further comprises:
- a storage unit configured to store a predetermined initial jet period that begins at the jet starting timing; and
- a control device configured to switch the operating state of the second valve device and to put the operating state of the second valve device into the small flow rate state in a period corresponding to the predetermined initial jet period, the period being in the jet period, and in the predetermined initial jet period that begins at the predetermined jet starting timing, the operating state of the second valve device is put into the small flow rate state, in which the flow rate smaller than the steady flow rate is supplied.

2. The weft insertion method according to claim 1, wherein the weft insertion device further includes a third main nozzle that is arranged upstream from the second main nozzle in the weft insertion direction and is connectable to a third valve device, and,
- over the jet period, the third valve device is put into the state in which the steady flow rate is supplied.

3. The weft insertion method according to claim 2, wherein
- the second valve device is provided integrally with the second main nozzle.

4. The weft insertion method according to claim 1, wherein
- the second valve device is provided integrally with the second main nozzle.

5. A weft insertion device for an air jet loom comprising:
- a first main nozzle for weft insertion; and
- a second main nozzle that is arranged upstream from the first main nozzle in a weft insertion direction and is configured to function as an auxiliary main nozzle, wherein
- the first main nozzle is connectable to a first valve device by a first piping,
- the second main nozzle is connectable to a second valve device by a second piping shorter than the first piping,
- the weft insertion device is configured to supply compressed air to each main nozzle with each valve device being in an open state over a jet period from a predetermined jet starting timing,
- the second valve device includes a single lead-in flow path into which compressed air is supplied and is configured by combining:
  - a valve for steady flow rate that implements a state in which the steady flow rate, which is a flow rate in a steady state of jet, is supplied; and
  - a valve for small flow rate that implements a small flow rate state, which is a state in which a flow rate smaller than the steady flow rate is supplied,
  - the second valve device is configured to switch an operating state of the second valve device between the state in which the steady flow rate is supplied and the small flow rate state, and
- the weft insertion device further comprises:
  - a storage unit configured to store a predetermined initial jet period that begins at the jet starting timing; and
  - a control device configured to switch the operating state of the second valve device and to put the operating state of the second valve device into the small flow rate state in a period corresponding to the predetermined initial jet period, the period being in the jet period.

6. The weft insertion device according to claim 5, wherein the weft insertion device further comprises a third main nozzle that is arranged upstream from the second main nozzle in the weft insertion direction and is connectable to a third valve device, and, over the jet period, the third valve device is put into a state in which the steady flow rate is supplied.

7. The weft insertion device according to claim 6, wherein the second valve device is provided integrally with the second main nozzle.

8. The weft insertion device according to claim 5, wherein the second valve device is provided integrally with the second main nozzle.

* * * * *